US010578089B2

(12) United States Patent
Cain

(10) Patent No.: US 10,578,089 B2
(45) Date of Patent: Mar. 3, 2020

(54) AIR COMPRESSOR NOISE DAMPENER

(71) Applicant: Matthew Scott Cain, Eaton, OH (US)

(72) Inventor: Matthew Scott Cain, Eaton, OH (US)

(73) Assignee: Eaton-Max, Inc., Clayton, OH (US)

( * ) Notice: Subject to any disclaimer, the term of this patent is extended or adjusted under 35 U.S.C. 154(b) by 183 days.

(21) Appl. No.: 15/473,730

(22) Filed: Mar. 30, 2017

(65) Prior Publication Data

US 2018/0283367 A1 Oct. 4, 2018

(51) Int. Cl.

*F04B 39/00* (2006.01)
*F04B 35/06* (2006.01)
*F04B 41/00* (2006.01)

(52) U.S. Cl.

CPC ..... *F04B 39/005* (2013.01); *F04B 39/0061* (2013.01); *F04B 39/0072* (2013.01); *F04B 35/06* (2013.01); *F04B 41/00* (2013.01)

(58) Field of Classification Search

CPC F04B 39/005; F04B 39/0061; F04B 39/0072; F04B 35/06; F04B 41/00
USPC ..... 181/198, 200, 214, 229
See application file for complete search history.

(56) References Cited

U.S. PATENT DOCUMENTS 2,510,887 A 6/1950 Hanson
4,264,282 A * 4/1981 Crago ..... F04C 29/066 181/202
5,118,262 A 6/1992 Kuo
5,332,872 A 7/1994 Ewanek
5,820,352 A 10/1998 Gunn et al.
6,375,437 B1 4/2002 Nolan
6,629,825 B2 10/2003 Stickland et al.
6,790,012 B2 * 9/2004 Sharp ..... F04B 39/0033 181/198
7,017,342 B2 3/2006 Iimura et al.
7,086,841 B2 8/2006 Cornwell
7,431,127 B2 * 10/2008 de Borchgrave ..... F04D 29/664 123/198 E
7,476,088 B2 1/2009 Iimura et al.
7,481,627 B2 1/2009 Beckman
7,641,449 B2 1/2010 Iimura et al.
7,704,052 B2 4/2010 Iimura et al.
8,117,960 B2 2/2012 Hartl et al.
8,282,363 B2 10/2012 Ohi et al.
8,579,600 B2 * 11/2013 Vijayakumar ..... F04D 13/06 417/234
8,714,947 B2 5/2014 Asai
8,784,070 B2 7/2014 Yokota et al.
8,821,131 B2 9/2014 Yokota et al.

(Continued)

FOREIGN PATENT DOCUMENTS

CN 107893768 A 4/2018
EP 1191225 A2 3/2002

(Continued)

*Primary Examiner* — Forrest M Phillips
(74) *Attorney, Agent, or Firm* — Barnes & Thornburg LLP

(57) ABSTRACT

An air compressor noise dampener. The dampener includes a housing having at least one inlet and at least one outlet. At least one baffle is secured within the housing in between the inlet and the outlet. The baffle includes an opening offset from the outlet so that sound waves traveling into the outlet hits a portion of the baffle prior to traveling through the opening. The present invention further includes a tube fluidly connecting the outlet with an intake of the air compressor.

21 Claims, 4 Drawing Sheets

(56) References Cited

U.S. PATENT DOCUMENTS

| | | | | |
|---|---|---|---|---|
| 8,967,324 | B2 | 3/2015 | White et al. | |
| 9,353,739 | B2 | 5/2016 | Wilson et al. | |
| 9,435,329 | B2 | 9/2016 | Kitagawa et al. | |
| 9,476,421 | B2 | 10/2016 | Cesak et al. | |
| 9,518,587 | B2 | 12/2016 | Yokota et al. | |
| 9,528,506 | B2 | 12/2016 | Yoshida et al. | |
| 9,903,358 | B2 | 2/2018 | Hernandez et al. | |
| 9,982,665 | B2 | 5/2018 | Ichihashi | |
| 2002/0027041 | A1* | 3/2002 | Czabala | F04C 29/065 181/229 |
| 2006/0144637 | A1* | 7/2006 | Swartz | F01C 21/10 181/198 |
| 2010/0303658 | A1 | 12/2010 | Ito et al. | |
| 2013/0062141 | A1* | 3/2013 | Wood | F04B 23/10 181/229 |
| 2017/0037844 | A1 | 2/2017 | Takeuchi et al. | |
| 2017/0184087 | A1 | 6/2017 | Bock et al. | |
| 2018/0017062 | A1 | 1/2018 | Peters et al. | |
| 2018/0119687 | A1 | 5/2018 | Asai | |
| 2018/0223832 | A1 | 8/2018 | Ren et al. | |
| 2018/0230983 | A1 | 8/2018 | Wood et al. | |

FOREIGN PATENT DOCUMENTS

| | | | | |
|---|---|---|---|---|
| EP | 1191225 | A3 | 6/2003 | |
| EP | 2006541 | A2 * | 12/2008 | F04B 35/06 |
| GB | 653515 | | 5/1951 | |

* cited by examiner

AIR COMPRESSOR NOISE DAMPENER

BACKGROUND OF THE INVENTION

The present invention relates to air compressors and, more particularly, to an air compressor noise dampener.

An air compressor is a device that converts power (using an electric motor, diesel or gasoline engine, etc.) into potential energy stored in pressurized air. By one of several methods, an air compressor forces more and more air into a storage tank, increasing the pressure. When tank pressure reaches its upper limit the air compressor shuts off. The compressed air, then, is held in the tank until called into use. The intake of the air compressor is unpleasantly loud, especially when used indoors.

As can be seen, there is a need for a silencer that dampens the noise caused by an intake of an air compressor.

SUMMARY OF THE INVENTION

In one aspect of the present invention, an air compressor noise dampener comprises: a housing comprising at least one inlet and at least one outlet; at least one baffle secured within the housing in between the inlet and the outlet, wherein the at least one baffle comprises an opening offset from the at least one outlet so that sound waves traveling into the at least one outlet hits a portion of the at least one baffle prior to traveling through the opening; and a tube comprising a first end connectable to the outlet and a second end connectable to an intake of an air compressor.

In another aspect of the present invention, an air compressor noise dampener comprises a housing comprising at least one inlet and at least one outlet; a plurality of baffles disposed within the housing in between the at least one inlet and the at least one outlet above and below one another, wherein each of the plurality of baffles is a plate having a first end opposite a second end, wherein the plurality of baffles comprises a first baffle comprising a first baffle opening formed through the first end, a second baffle comprising a second baffle opening formed through the second end and a third baffle comprising a third baffle opening formed through the first end, wherein the second baffle is disposed in between the first baffle and the third baffle; and a tube comprising a first end connectable to the outlet and a second end connectable to an intake of an air compressor.

These and other features, aspects and advantages of the present invention will become better understood with reference to the following drawings, description and claims.

DETAILED DESCRIPTION OF THE INVENTION

Figure 1:
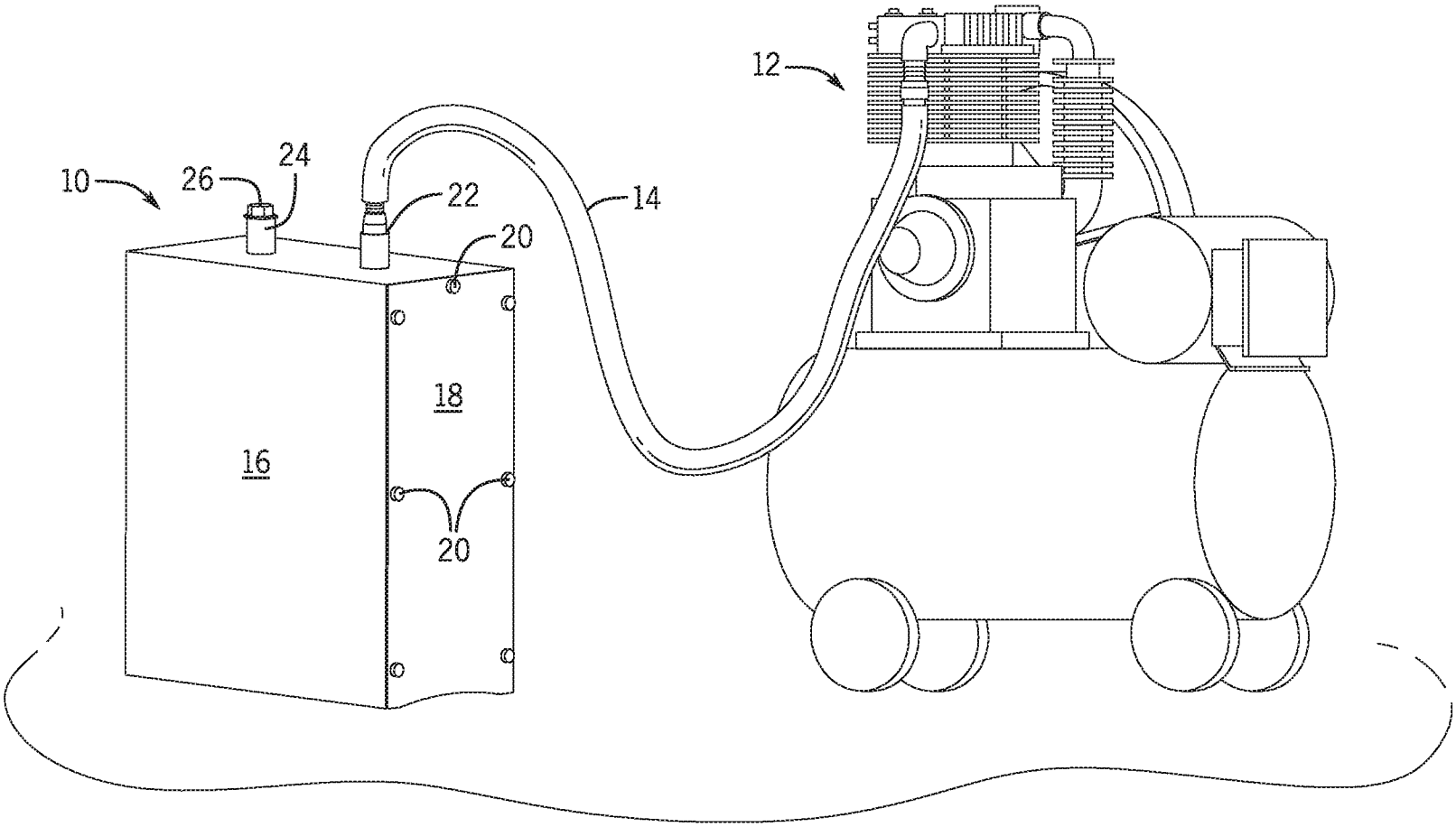
FIG. 1 is a front perspective view of an embodiment of the present invention in use.
Figure 2:
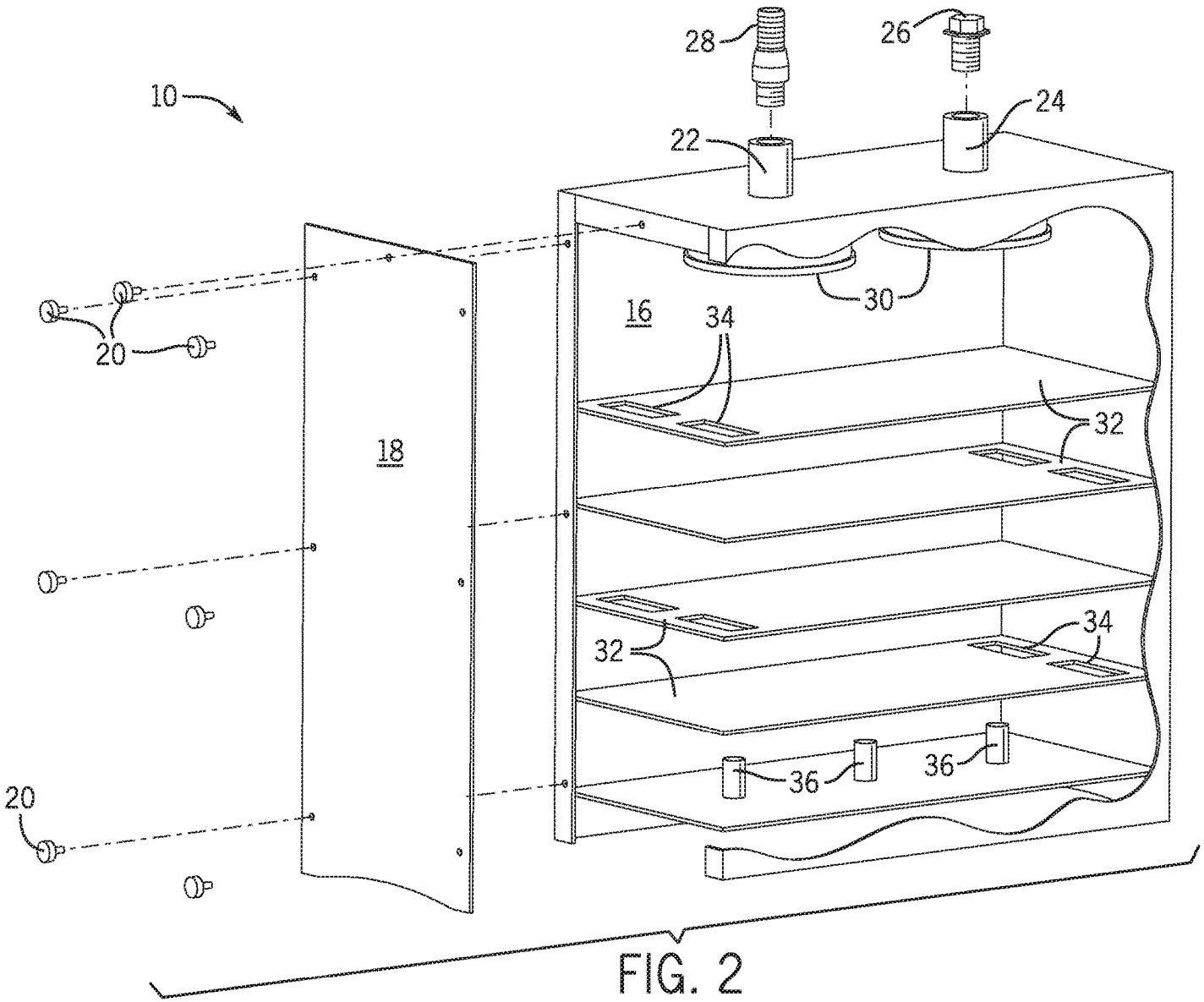
FIG. 2 is an exploded perspective view of an embodiment of the present invention.
Figure 3:
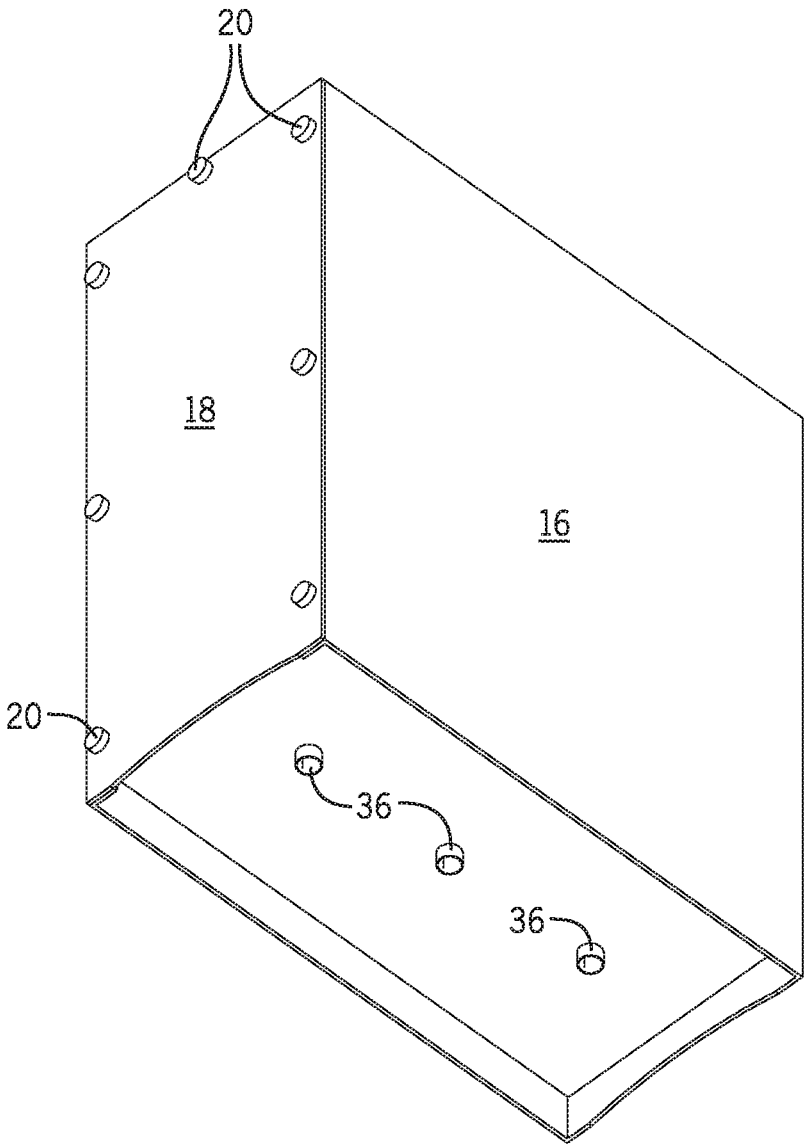
FIG. 3 is a bottom perspective view of an embodiment of the present invention.

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

The present invention includes a noise suppression silencer for an air compressor. The present invention suppresses noise from the intake side of the compressor pump, which makes the compressor relatively quiet during use in a garage or shop. The present invention reduces the compressor noise by five to ten decimals more than other devices. The present invention utilizes inner baffles to capture the intake noise of the compressor.

The present invention includes a metal box that captures the intake noise of the air compressor. An air filter may also be used to reduce some noise, while the inner baffles suppresses the noise as it goes through the silencer. A bottom wall of the metal box may include welded pipes to capture the last part of the noise. The pipes allow good air flow but traps the noise of the compressor in the silencer.

Referring to FIGS. 1 through 4, the present invention includes an air compressor noise dampener 10. The dampener 10 includes a housing 16 having at least one inlet 36 and at least one outlet 22, 24. At least one baffle 32 is secured within the housing 16 in between the inlet 36 and the outlet 22, 24. The baffle 32 includes an opening 34 offset from the outlet 22, 24 so that sound waves entering through the outlet 22, 24 hits a portion of the baffle prior to traveling through the opening 34. The present invention further includes a tube 14, such as a rubber hose. The tube 14 fluidly connects the outlet 22, 24 with an intake of an air compressor 12.

In certain embodiments, the housing 16 includes a top wall, a bottom wall and a sidewall. The sidewall may be rounded or rectangular forming four sidewalls. One of the four sidewalls may be a front plate 18 releasably secured to the remainder of the housing 16 by a plurality of screws 20 running through aligning openings. The bottom wall may include the inlet 36 and is disposed above bottom edges of the four sidewalls. The top wall may include the outlet 22, 24. The bottom edge of at least one of the four sidewalls is recessed to allow air to pass through. The inlet 36 may include a plurality of pipes secured to the bottom wall.

Figure 4:
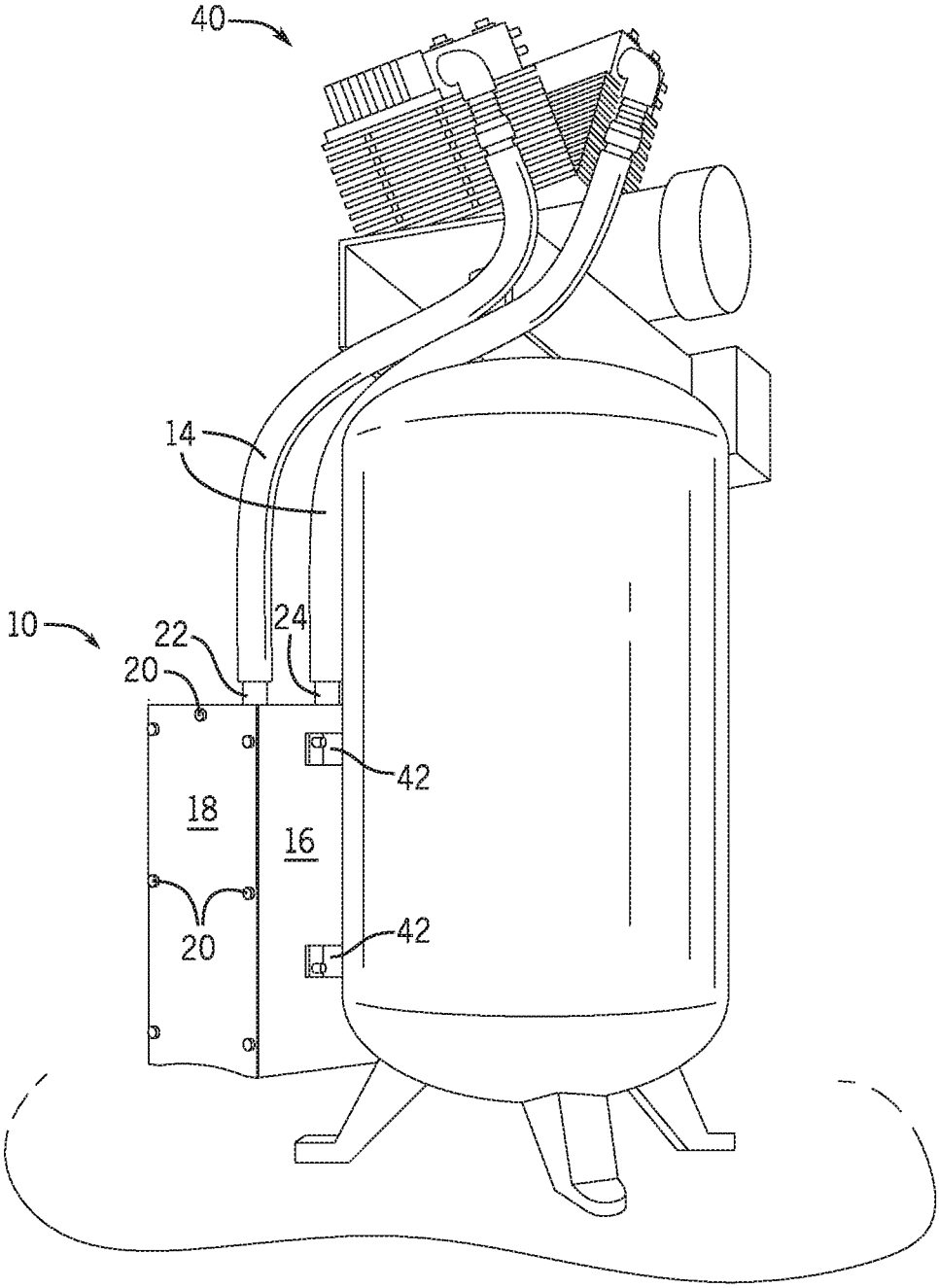
FIG. 4 is a perspective view of an embodiment of the present invention.

The at least one outlet 22, 24 may include a first threaded port 22 and a second threaded port 24. At least one tube fitting 28 includes a male threaded connector mechanically fastened to the first threaded port 22. The first end of the tube 14 may secured to the tube fitting 28. The present invention may further include a plug 26. The plug 26 also includes a male threaded connector which is mechanically fastened to the second threaded port 24. The plug 26 blocks the passageway of the second threaded port 24. As illustrated in FIG. 4, a compressor 40 may include two intakes. If the compressor 40 includes two intakes, the present invention may include a tube fitting 28 secured within each of the first threaded port 22 and the second threaded port 24. Two tubes 14 may connect the two tube fittings 28 to the two intakes of the compressor 40.

In certain embodiments, the present invention includes a plurality of baffles 32 disposed above and below one another. Each of the plurality of baffles 32 is a plate having a first end opposite a second end. The plurality of baffles 32 include a first baffle 32 having a first baffle opening 34 formed through the first end, a second baffle 32 having a second baffle opening 34 formed through the second end and a third baffle 32 having a third baffle opening 34 formed through the first end. The second baffle 32 is disposed in between the first baffle 32 and the third baffle 32.

In certain embodiments, the air compressor noise dampener 10 may be directly connected to the air compressor 40.

As illustrated in FIG. 4, the present invention may include brackets 42. The brackets 42 are connected to an outer surface of the housing 16. The brackets 42 secure to the housing 16 directly to the air compressor 40.

In use, the first end of the tube 14 is secured to the tube fitting 28 and the second end of the tube 14 is secured to the intake of the compressor 12. The compressor 12 is turned on and draws air through the intake. The air is pushed through the recess of the sidewall, through the inlet 36, and through each of the openings 34 of the baffles 32. Sounds from the intake travels through the tube 14 and into the housing 16. The baffles 32 reduce the sound created by the intake by containing the sound waves in between the baffles 32. The sound may further be reduced by securing air filters 30 to block the passage ways of the first threaded port 22 and the second threaded port 24.

It should be understood, of course, that the foregoing relates to exemplary embodiments of the invention and that modifications may be made without departing from the spirit and scope of the invention as set forth in the following claims.

What is claimed is:

1. An air compressor noise dampener comprising:

a housing including at least one inlet having a perimeter defining area and at least one outlet having a perimeter defining an area;

at least one baffle secured within the housing in between the at least one inlet and the at least one outlet, wherein the at least one baffle includes an opening having a perimeter defining an area, the opening in the baffle positioned such that the area defined by the perimeter of the opening in the baffle does not overlap the area defined by the perimeter of the at least one outlet; and a tube having a first end connectable to the outlet and a second end connectable to an intake of an air compressor.

2. The air compressor noise dampener of claim 1, wherein the housing includes four sidewalls, a top wall, and a bottom wall, wherein the bottom wall includes the at least one inlet and is disposed above bottom edges of the four sidewalls, the top wall includes the at least one outlet, and the bottom edge of at least one of the four sidewalls is recessed to allow air to pass through.

3. The air compressor noise dampener of claim 2, wherein the at least one inlet includes a pipe secured to the bottom wall.

4. The air compressor noise dampener of claim 1, wherein the at least one baffle includes a plurality of baffles disposed above and below one another, wherein each of the plurality of baffles is a plate having a first end opposite a second end.

5. The air compressor noise dampener of claim 4, wherein the plurality of baffles includes a first baffle having a first baffle opening formed through the first end, a second baffle having a second baffle opening formed through the second end and a third baffle having a third baffle opening formed through the first end, wherein the second baffle is disposed in between the first baffle and the third baffle.

6. The air compressor noise dampener of claim 1, wherein the at least one outlet includes a first threaded port and a second threaded port.

7. The air compressor noise dampener of claim 6, further including at least one tube fitting and a plug, wherein the at least one tube fitting includes a male threaded connector mechanically fastened to the first threaded port, wherein the plug includes a male threaded connector mechanically fastened to the second threaded port.

8. The air compressor noise dampener of claim 1, further including an air filter covering a passageway through the at least one outlet.

9. The air compressor noise dampener of claim 1, further including a mount bracket connected to an outer surface of the housing and operable to secure the housing to the air compressor.

10. The air compressor noise dampener of claim 1, wherein the opening in the baffle is positioned such that the area defined by the perimeter of the opening in the baffle does not overlap the area defined by the perimeter of the at least one inlet.

11. An air compressor noise dampener including:

a housing having a first side, a second side, an inlet having a perimeter defining an area and an outlet having a perimeter defining an area;

a first baffle located in the housing having a first end located adjacent the first side of the housing, a second end located adjacent the second side of the housing, and an opening adjacent the first end, the opening having a perimeter defining an area;

a second baffle located in the housing having a first end located adjacent the first side of the housing, a second end located adjacent the second side of the housing, and an opening adjacent the second end, the opening having a perimeter defining an area;

a third baffle located in the housing having a first end located adjacent the first side of the housing, a second end located adjacent the second side of the housing, and an opening adjacent the first, end, the opening having a perimeter defining an area; and wherein the first baffle is closer to the inlet than to the outlet and the area defined by the perimeter of the opening in the first baffle does not overlap the area defined by the perimeter of the inlet.

12. The air compressor noise dampener of claim 11, wherein the third baffle is closer to the outlet than to the inlet and the area defined by the perimeter of the opening in the third baffle does not overlap the area defined b the perimeter of the outlet.

13. The air compressor noise dampener of claim 11, wherein the second baffle is located between the first baffle and the third baffle and the area defined by the perimeter of the opening in the second baffle does not overlap the area defined by the perimeter of the opening in the first baffle or the area defined by the perimeter of the opening in the third baffle.

14. An air compressor noise dampener including:

a housing having a first side, a second side, an inlet having a perimeter defining an area and an outlet having a perimeter defining an area;

a first baffle located in the housing having a first end located adjacent the first side of the housing, a second end located adjacent the second side of the housing, and an opening adjacent the first end, the opening having a perimeter defining an area;

a second baffle located in the housing having a first end located adjacent the first side of the housing, a second end located adjacent the second side of the housing, and an opening adjacent the second end, the opening having a perimeter defining an area;

a third baffle located in the housing having a first end located adjacent the first side of the housing, a second end located adjacent the second side of the housing, and an opening adjacent the first end, the opening having a perimeter defining an area; and wherein the third baffle is closer to the outlet than to the inlet and the area defined by the perimeter of the opening in the third baffle does not overlap the area defined by the perimeter of the outlet.

15. The air compressor noise dampener of claim 14, wherein the first baffle is closer to the inlet than to the outlet and the area defined by the perimeter of the opening in the first baffle does not overlap the area defined by the perimeter of the inlet.

16. The air compressor noise dampener of claim 14, wherein the second baffle is located between the first baffle and the third baffle and the area defined by the perimeter of the opening in the second baffle does not overlap the area defined by the perimeter of the opening in the first baffle or the area defined by the perimeter of the opening in the third baffle.

17. An air compressor noise dampener including:

a housing having a first side, a second side, an inlet having a perimeter defining an area and an outlet having a perimeter defining an area;

a first baffle located in the housing having a first end located adjacent the first side of the housing, a second end located adjacent the second side of the housing, and an opening adjacent the first end, the opening having a perimeter defining an area;

a second baffle located in the housing having a first end located adjacent the first side of the housing, a second end located adjacent the second side of the housing, and an opening adjacent the second end, the opening having a perimeter defining an area;

a third baffle located in the housing having a first end located adjacent the first side of the housing, a second end located adjacent the second side of the housing, and an opening adjacent the first end, the opening having a perimeter defining an area;

wherein the first baffle is closer to the inlet than to the outlet and the area defined by the perimeter of the opening in the first baffle does not overlap the area defined by the perimeter of the inlet;

wherein second baffle is located between the first baffle and the third baffle and the area defined by the perimeter of the opening in the second baffle does not overlap the area defined by the perimeter of the opening in the first baffle or the area defined by the perimeter of the opening in the third baffle; and wherein the third baffle is closer to the outlet than to the inlet and the area defined by the perimeter of the opening in the third baffle does not overlap the area defined by the perimeter of the outlet.

18. The air compressor noise dampener of claim 17, wherein the area defined by the perimeter of the opening in the second baffle does not overlap the area defined by the perimeter of the inlet.

19. The air compressor noise dampener of claim 17, wherein the area defined by the perimeter of the opening in the second baffle does not overlap the area defined by the perimeter of the outlet.

20. The air compressor noise dampener of claim 17, wherein the area defined by the perimeter of the opening in the first baffle does not overlap the area defined by the perimeter of the outlet.

21. The aft compressor noise dampener of claim 17, wherein the area defined by the perimeter of the opening in the third baffle does not overlap the area defined by the perimeter of the inlet.

* * * * *